US010478644B2

(12) United States Patent
Leggett et al.

(10) Patent No.: US 10,478,644 B2
(45) Date of Patent: Nov. 19, 2019

(54) FIREFIGHTER HOOD WITH PROTECTIVE FLAP

(71) Applicant: Lion Group, Inc., Dayton, OH (US)

(72) Inventors: Michael Leggett, New Ringgold, PA (US); Jake Leggett, Lehighton, PA (US); Janeane Matula, New Ringgold, PA (US)

(73) Assignee: LION GROUP, INC., Dayton, OH (US)

( * ) Notice: Subject to any disclaimer, the term of this patent is extended or adjusted under 35 U.S.C. 154(b) by 132 days.

(21) Appl. No.: 15/420,707

(22) Filed: Jan. 31, 2017

(65) Prior Publication Data

US 2017/0225016 A1 Aug. 10, 2017

Related U.S. Application Data

(60) Provisional application No. 62/291,857, filed on Feb. 5, 2016.

(51) Int. Cl.

| | |
|---|---|
| ***A62B 17/04*** | (2006.01) |
| ***A24B 1/04*** | (2006.01) |
| ***A42B 1/06*** | (2006.01) |
| ***A62B 17/00*** | (2006.01) |
| ***A42B 1/04*** | (2006.01) |
| *A62B 18/08* | (2006.01) |

(52) U.S. Cl.

CPC ..... *A62B 17/04* (2013.01); *A42B 1/041* (2013.01); *A42B 1/046* (2013.01); *A42B 1/06* (2013.01); *A62B 17/003* (2013.01); *A62B 18/084* (2013.01)

(58) Field of Classification Search

CPC .. A42B 1/046; A42B 1/06; A42B 1/04; A42B 1/041; A42B 1/006; A42B 1/045; A62B 17/04; A62B 17/003; A62B 18/084

USPC ..... 2/202, 84, 203, 205

See application file for complete search history.

(56) References Cited

U.S. PATENT DOCUMENTS

| | | | | | |
|---|---|---|---|---|---|
| 214,326 | A | * | 4/1879 | Troelicht | A42B 1/046 2/205 |
| 1,097,530 | A | * | 5/1914 | Cabelinsky | 2/10 |
| 2,839,757 | A | * | 6/1958 | Gianola | A42B 1/045 2/173 |
| 4,573,217 | A | | 3/1986 | Reed | |
| D286,222 | S | * | 10/1986 | Talbot | D29/106 |
| 5,125,114 | A | | 6/1992 | Grilliot et al. | |
| D331,300 | S | * | 11/1992 | Fountain | D29/108 |
| 5,251,336 | A | * | 10/1993 | Nevins | A42B 1/046 2/173 |
| 5,274,850 | A | | 1/1994 | Aldridge | |
| D366,347 | S | * | 1/1996 | Avey | D29/106 |
| 5,575,009 | A | * | 11/1996 | Ryvin | A41D 13/1153 2/173 |

(Continued)

*Primary Examiner* — Amy Vanatta

(74) *Attorney, Agent, or Firm* — Thompson Hine LLP

(57) ABSTRACT

A firefighter hood comprising a hood body configured to fit around a head of a wearer, wherein the hood body includes a face opening configured to be aligned with a face of the wearer when the hood is worn. The hood further includes a flap coupled to the hood body. The flap is movable between an extended position wherein the flap covers only part of the opening in front view, and a retracted position wherein the flap does not cover any of the opening in front view or covers less of the opening in front view compared to when the flap is in the extended position.

24 Claims, 5 Drawing Sheets

(56) References Cited

U.S. PATENT DOCUMENTS

| | | | | |
|---|---|---|---|---|
| 5,704,068 | A * | 1/1998 | Martin | A41D 13/1153 128/201.13 |
| 5,765,230 | A * | 6/1998 | Sivret | A42B 1/046 2/202 |
| 5,822,800 | A * | 10/1998 | Anderson | A42B 1/041 2/202 |
| 6,023,787 | A * | 2/2000 | French | A41D 13/1153 2/173 |
| 6,088,838 | A * | 7/2000 | Sontag | A42B 1/046 2/202 |
| 6,269,489 | B1 | 8/2001 | Heath | |
| D566,338 | S * | 4/2008 | Van Trojen | A42B 1/045 D29/106 |
| 7,779,485 | B2 | 8/2010 | Gandy | |
| 7,823,222 | B2 | 11/2010 | Grilliot et al. | |
| 8,726,415 | B2 | 5/2014 | Grilliot et al. | |
| 9,521,873 | B1 * | 12/2016 | Mignone | A41D 13/1161 |
| 2006/0130213 | A1 * | 6/2006 | Mickle | A42B 1/046 2/202 |
| 2006/0143796 | A1 * | 7/2006 | Bugarin | A41D 23/00 2/202 |
| 2008/0196145 | A1 | 8/2008 | Grilliot et al. | |
| 2012/0233748 | A1 | 9/2012 | Curtis | |
| 2015/0113711 | A1 * | 4/2015 | Kim | A42B 1/046 2/424 |
| 2017/0196280 | A1 * | 7/2017 | Murphy | A41D 13/1153 |

* cited by examiner

FIREFIGHTER HOOD WITH PROTECTIVE FLAP

This application claims priority to U.S. Provisional Patent Application Ser. No. 62/291,857, filed on Feb. 5, 2016 and entitled FIREFIGHTER HOOD WITH PROTECTIVE FLAP, the entire contents of which are hereby incorporated by reference.

BACKGROUND

Hoods are commonly used by firefighters and other personnel who wear protective gear to provide thermal protection and/or protection from flames, abrasion forces, etc. Protective hoods are often used in conjunction with masks, such as masks associated with self-contained breathing apparatuses (SCBA). The masks and hoods are often design to create a seal therebetween when worn to protect the wearer's the head, face, neck and chin from exposure to heat, debris, smoke, harmful gases, embers or the like and to provide a sealed environment for the wearer. However, in some cases the seal between the mask and the hood can be compromised, particularly when the wearer tilts his or her head at an angle, such as at an upward angle.

SUMMARY

In one embodiment, the present invention is a hood with a flap to help protect the wearer. More particularly, in one embodiment the invention is a firefighter hood comprising a hood body configured to fit around a head of a wearer, wherein the hood body includes a face opening configured to be aligned with a face of the wearer when the hood is worn. The hood further includes a flap coupled to the hood body. The flap is movable between an extended position wherein the flap covers only part of the opening in front view, and a retracted position wherein the flap does not cover any of the opening in front view or covers less of the opening in front view compared to when the flap is in the extended position.

DETAILED DESCRIPTION

Figure 1:
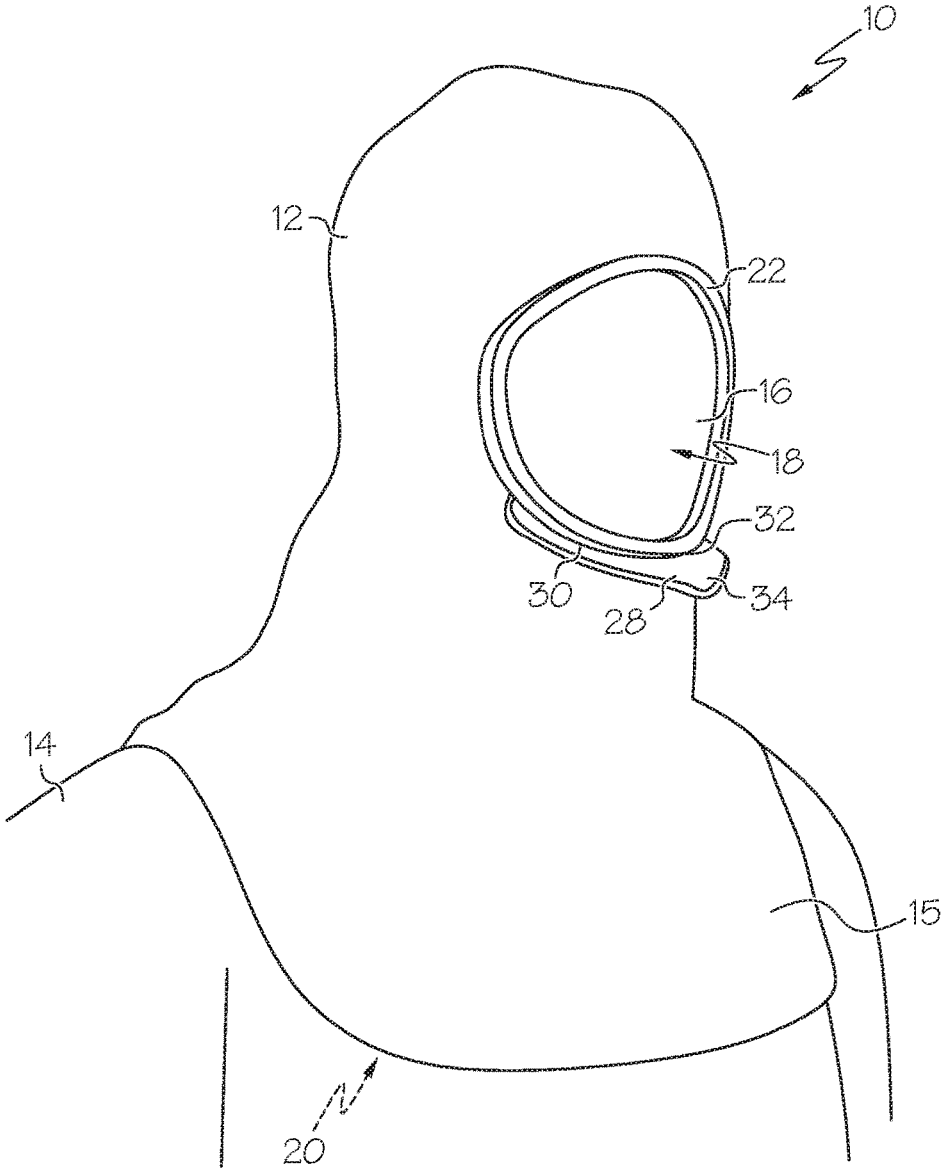
FIG. 1 is a front perspective view of one embodiment of a hood of the present invention, shown on a wearer and with the flap in a retracted position.

FIGS. 1-5 illustrate one embodiment of the hood 10 of the present invention. The hood 10 can include a hood body 12 configured to fit around a head of a wearer 14 and include a bib portion 15 configured to fit about the chest, shoulders and/or back of a wearer. The hood body 12 includes a face opening 16 extending through a thickness of the hood body 12 to an inner cavity 18 of the hood 10. The face opening 16 is configured to be aligned with a face of the wearer 14 when the hood 10 is worn. In one case, the hood body 12 covers the entirety of the face/head of a wearer 14 besides those portions of the wearer's face exposed through the face opening 16.

In one embodiment the face opening 16 is generally oval (including elliptical and/or circular as subsets thereof) and has an outer perimeter extending entirely thereabout and has a surface area of at least about 10 square inches (64.5 square centimeters) in one case, or at least about 15 square inches (96.77 square centimeters) in another case, and less than about 30 square inches (193.5 square centimeters) in one case, or less than about 25 square inches (161.29 square centimeters) in yet another case, to provide an opening 16 that generally corresponds in size to the face of the wearer 14.

Each layer of the hood 10, and the hood 10 as a whole, may meet the National Fire Protection Association 1971 standards ("NFPA Standards") for protective firefighting garments ("Protective Clothing for Structural Firefighting"), which standards, as of the filing date of this application, are entirely incorporated by reference herein. Unless the face opening 16 is designed to interface with a specific SCBA face piece, current NFPA Standards require the face opening 16 have a diameter of 5⅝ inch (+/−1 inch) (14.29 cm +/−2.54 cm) when the hood 10 is laid out in a relaxed condition on a flat surface, smoothed out, and with the face opening 16 facing upward. Current NFPA Standards also require that the face opening 16 be stretchable to a circumference of no less than 31 inches (78.74 cm). The face opening 16 may be sized and shaped, and sufficiently elastically stretchable, that a wearer 14 with an average sized head can pass his or her head entirely through the face opening 16. This can be useful so that hood 10 can be stored around the wearer's neck when when donning or doffing a face mask 26 while wearing the hood 10.

The hood body 12 can include a bottom opening 20 through which a wearer 14 can pass his or her head through to don or doff the hood 10. In one embodiment the hood body 12 is generally continuous and lacks any openings, slits or the like other than the face opening 16 and the bottom opening 20.

The hood body 12 can be made of a variety of materials, including a knit, woven or fleece material, or a soft, non-woven material. The hood body 12 material can be a flame resistant and/or thermally insulating material, including aramid material such as NOMEX or KEVLAR, a blend of aramid materials, a PBI material, a Lenzing P84 material, a modacrylic material, a rayon material, an Oxidized Polyacrylonitrile (OPF) material, a carbon fiber material, and/or a blend of aramid, PBI materials and other material, and/or materials that can be treated with an additive or additives to increase flame and/or thermal resistance. The hood body 12 can be treated with a durable, water-repellant finish to substantially prevent the absorption or penetration of liquid moisture therethrough. In one case the hood body 12 can be made of a material the same as or similar to that used for the wristlets of a firefighter garment as described in U.S. Pat. No. 6,038,700, the entire contents of which are hereby incorporated by reference.

The hood 10/hood body 12 may include elastic properties such that, for example in one case, the hood 10/hood body 12 can stretch at least about 10% in a plane when stretching forces are applied and return to its pre-stretched shape when such stretching forces are removed. Such elastic properties may ensure that the hood 10/hood body 12 can stretch to accommodate a wearer's head passing through the bottom opening 20 and through the neck of the hood 10 when donning and doffing the hood 10, but returns to (or tries to return to) its original shape to protect the wearer 14 when worn. The elastic properties of the hood 10/hood body 12 may be accomplished in a variety of ways, including by making the hood 10/hood body 12 of a knit material of sufficient elasticity and/or incorporating elastic fibers into the material of the hood 10/hood body 12.

Current NFPA Standards specify various minimum requirements for heat and flame resistance and tear strength. For example, in order to meet the NFPA standards, the hood 10 must be able to resist igniting, burning, melting, dripping and/or separation at a temperature of 500° F. (260° C.) for at least five minutes. Where hood face openings 16 are designed to interface with a specific NFPA face piece, such hood face openings 16 should overlap the outer edge of the specific SCBA face piece-to-face seal perimeter by not less than one half inch (1.27 cm). Furthermore, in order to meet the NFPA standards, all combined layers of the hood 10 must provide a thermal protective performance ("TPP") rating of at least twenty. Alternately or in addition to the NFPA Standard 1971, the hood 10 disclosed herein may also meet European Norm ("EN") standards for firefighting garments set by the European Committee for Standardization (also known as Comité Européen de Normalisation ("CEN")). These standards include EN 469:2005 Level 1 and Level 2 certification. The EN standards for firefighter and protective garments in place as of the filing date of this application are entirely incorporated by reference herein.

Figure 4:
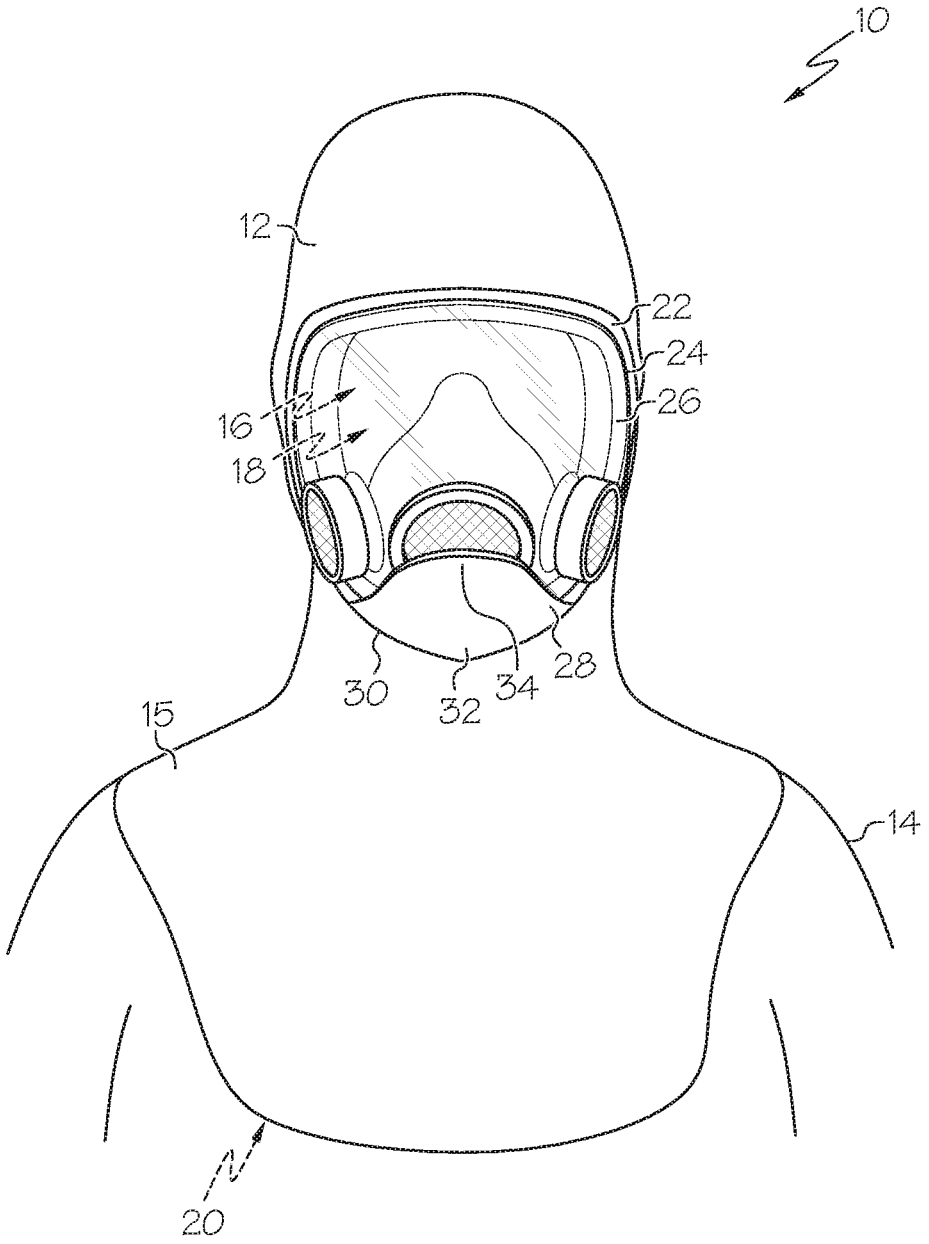
FIG. 4 is a front perspective view of the hood and wearer of FIG. 3, shown in conjunction with a face mask.

In one embodiment the hood 10 includes a sealing material 22 coupled to the hood body 12 and extending around the entire perimeter of the opening 16. The sealing material 22 can be a different material/separate component from the material of the hood body 12. In one case the sealing material 22 can be made of an airtight or generally airtight material and configured to align with and sealingly engage the seal 24 of a face mask 26 of part of a SCBA system in one case, as shown in FIG. 4, to form a seal therewith. The sealing material 22 can also be elastic and/or flexible (including having the same elasticity parameters as outlined above for the hood 10/hood body 12) to enable the opening 16/sealing material 22 to be adjusted as desired to align with and sealingly engage the seal 24 of the face mask 26 and/or to enable the wearer's head to fit through the opening 16 as outlined above. In one case the sealing material 22 is made of rubber, synthetic rubber, an elastomer material or the like.

The hood 10 can include a hood flap 28 that is movably or pivotally coupled to the hood body 12. In one embodiment the hood flap 28 is coupled to the hood body 12 along a pivot line or connection location 30 positioned on and/or adjacent and/or immediately adjacent to the perimeter of the opening 16 and/or the sealing material 22.

The flap 28 can be made of the same materials as listed above for the hood body 12. In one embodiment the flap 28 is coupled to the hood body 12 by stitching to form the pivot line 30, although the flap 28 can be secured by other methods and mechanisms, such as by use of an adhesive, by forming the flap 28 from the same piece of material as the hood body 12, etc. The flap 28 can include a base end 32 attached to the body 12 along the pivot line 30 and also include a distal, opposite end 34.

The flap 28 is manually movable between an extended or engaged position (FIGS. 3-5), wherein the flap 28 covers at least part of the opening 16 in front view of the hood 10, and a retracted or disengaged position (FIGS. 1 and 2) wherein the flap 28 does not cover any of the opening 16 in front view, or covers less of the opening 16 in front view compared to when the flap 28 is in the extended position. The flap 28 may pivot about the pivot line 30 when the flap 28 moves between the extended and retracted position.

When the flap 28 is in its extended position, the flap 28 covers at least a portion of the opening 16 in front view. For example, in the illustrated embodiment the flap 28 covers a lower portion of the opening 16 (less than about 25% of the surface area of the opening in front view in one case) when in the extended position. When in the retracted position, in one case the flap 28 does not cover any of the opening 16 in front view. Alternatively, in one case when the flap 28 is in its retracted position the flap 28 can still cover some of the opening 16 in front view, but in this case the flap 28 can still cover less of the opening 16 compared to when the flap 28 is in its extended position.

Figure 2:
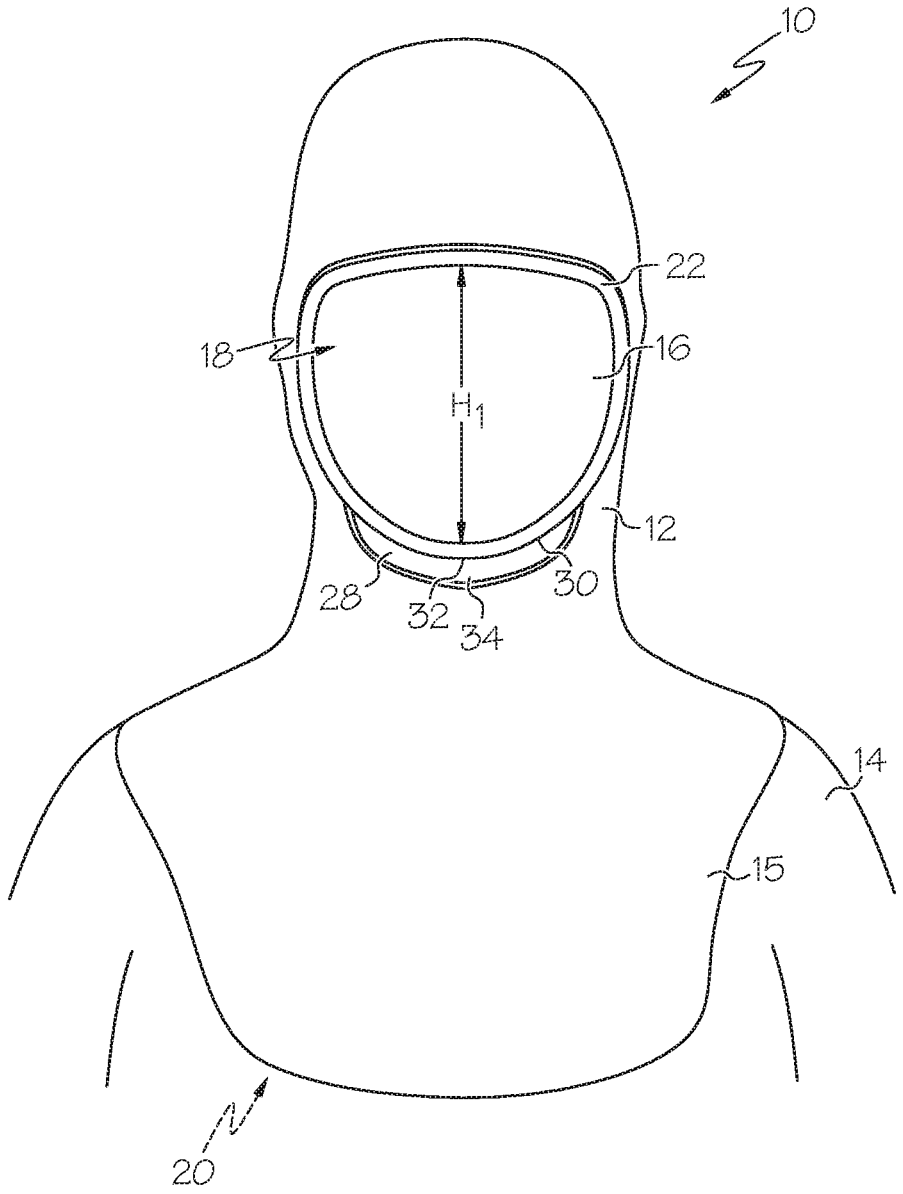
FIG. 2 is a front view of the hood and wearer of FIG. 1.
Figure 3:
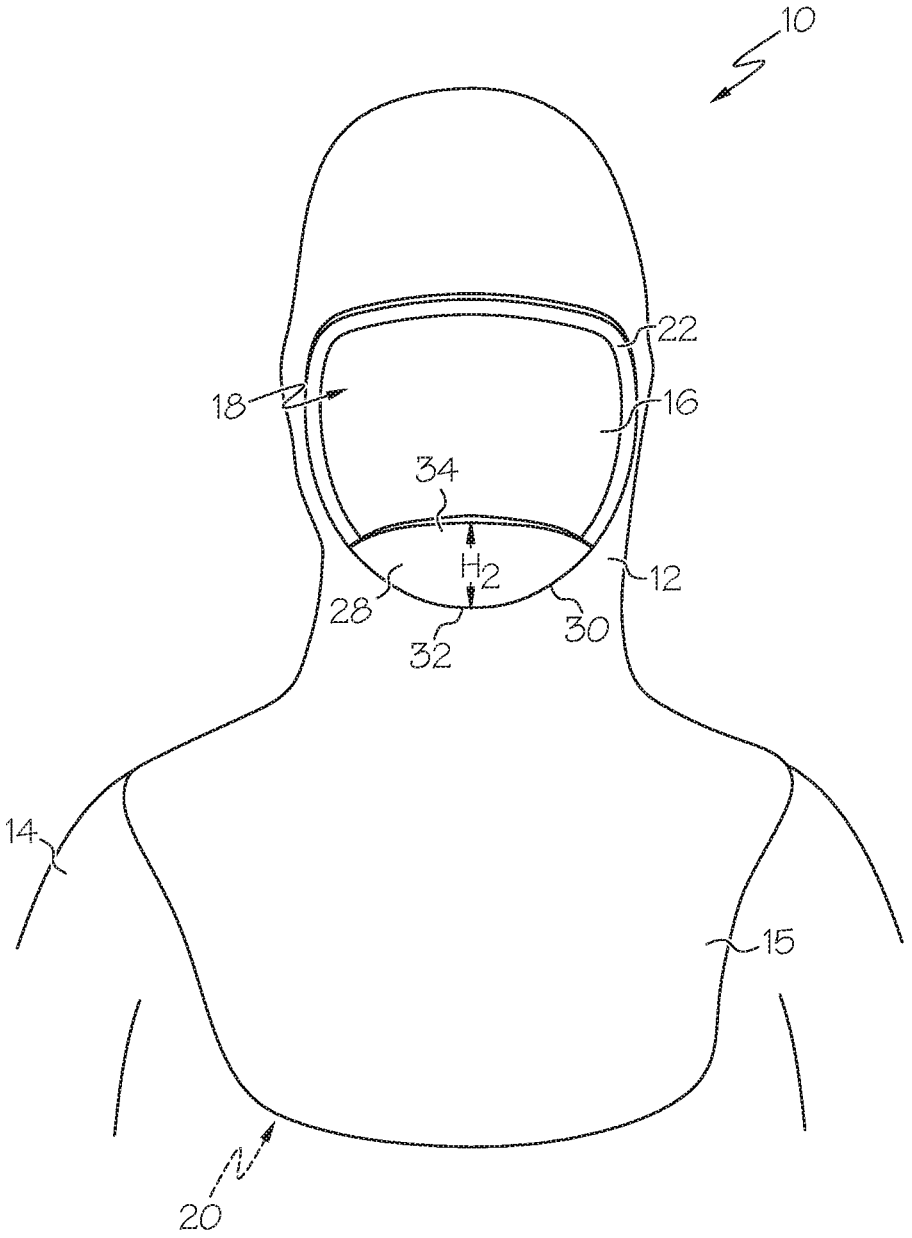
FIG. 3 is a front view of the hood and wearer of FIG. 2, with the flap in an extended position.
Figure 5:
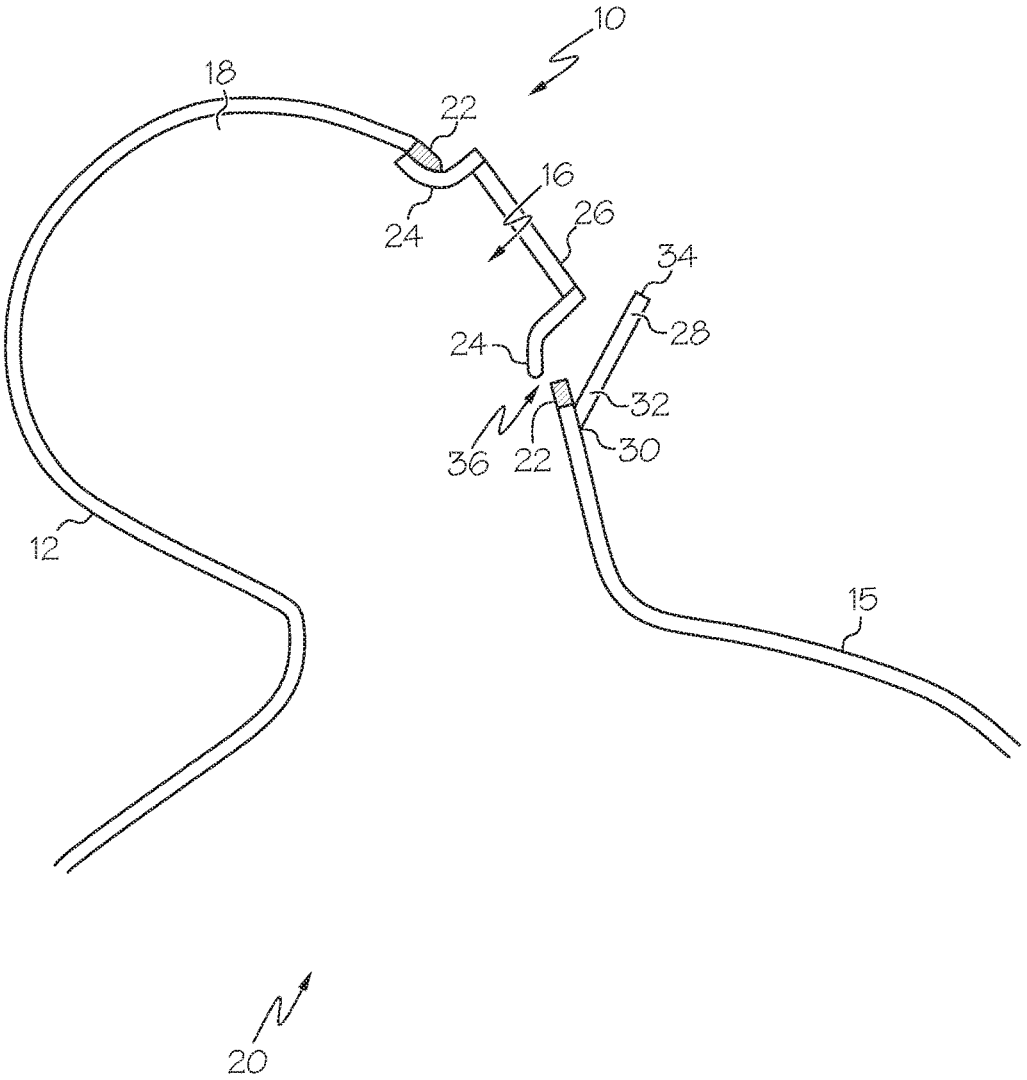
FIG. 5 is a side cross section of the hood and mask of FIG. 4, with the head tilted back, creating a gap between the mask and the hood.

In the embodiment shown in FIGS. 3-5, when in the extended position the flap 28 extends upwardly and away from the hood body 12/pivot line 30 at an angle, and in the embodiment of FIGS. 1 and 2, when in the retracted position the flap 28 extends downwardly and away from the hood body 12/pivot line 30 at an angle. However the flap 28 can take a variety of other positions when in its extended and/or retracted position, for example being oriented generally vertically.

In one case the hood body 12 can have a height dimension extending parallel to a height direction of a wearer when the hood 10 is worn, and the opening 16 can have a height dimension $H_1$ (FIG. 2) in the same direction. In the illustrated embodiment the flap 28 has a surface area less than a surface area of the opening 16 such that the entire opening 16 is not covered or able to be covered by the flap 28 to ensure the wearer 14 retains sufficient visibility through the opening 16 even when the flap 28 is in its extended position. In addition, in the illustrated embodiment the flap 28 has a length or height $H_2$ in front view when in its extended position or when in a vertical position (see FIG. 3) less than a height $H_1$ of the opening 16 such that the flap 28 cannot extend across an entire dimension of the opening 16. In this case then the flap 28 has a height $H_2$ in extending parallel to the height dimension $H_1$ of the opening 16 that is less than the height dimension $H_1$ of the opening 16. Alternatively, the flap 28 can have a height $H_2$, extending generally perpendicular to the pivot line 30 or a center thereof, that is less than a height dimension $H_1$ of the opening 16.

The base end 32 of the hood flap 28 may be positioned relatively close to the opening 16. Thus in one case the base end 32 of the flap 28 may be spaced away from the opening 16, in the height direction, no further than about ¼ of the height $H_1$ of the opening 16 in one case, or no more than about ½ of the height $H_1$ of the opening 16 in another case.

In one case the flap 28 is configured to be retained in the extended position without any outside forces, for example due to stiffness of the flap 28 and/or its configuration. For example in one case the flap 28 is pivotally attached to the hood body 12 along the pivot line 30 that is curved and/or non-linear. In this case when the flap 28 is moved from its retracted position to its extended position, the base end 32 of the flap 28 can be inverted from a concave configuration to a convex configuration (or vice versa), placing the flap 28 in tension in a cam-over arrangement, helping to retain the flap 28 in place. The curved shape of the flap 28 and/or its connection 30 also helps to naturally retain the flap 28 in its extended position. The flap 28 can also have sufficient stiffness to be retained in the extended position in a cantilever mounting arrangement. Thus as shown in FIGS. 3-5 in one case the flap 28 is configured to be retained in the extended position when the distal end 34 is free and unsupported, and is not directly attached to the body 12.

As mentioned above, with reference to FIG. 5 in some cases when a mask 26 is worn the mask 26 can move away from the sealing material 22, forming a gap 36 therebetween, particularly when the wearer raises his or her head, which creates a gap 36 along the bottom side of the mask 26/sealing material 22. The flap 28 can be positioned to cover the gap 36 (e.g. be vertically aligned with and/or extend vertically above and/or cover all or a majority the gap 36 in front view) when the flap 28 is in the extended position. The flap 28 thereby provides a barrier to direct entry of items into the gap 36 from the ambient environment to help to prevent debris (such as embers, flying particles, etc.) from entering the gap 36, and provides additional thermal and flame protection to thereby protect the wearer 14.

After the hood 10 is donned, the wearer 14 will typically next don a helmet (not shown) over the hood 10, and the helmet typically has a chin strap to help keep the helmet in place. The flap 28 can in some cases be positioned adjacent to the chin strap when the chin strap is worn on a wearer's chin. In this case the chin strap can be positioned on at least part of the flap 28 to help keep the flap 28 in either its extended or retracted position. Even when the chin strap is not positioned on at least part of the flap 28, the chin strap can be positioned immediately adjacent to the flap 28 and help hold up or wedge the flap 28 in its extended position when desired.

Thus the flap 28 is easily manually moved to the extended position to provide protection when desired, and can be easily manually moved to the retracted position when it is not desired to be used. The flap 28 can provide protection to the wearer and is simple and inexpensive to implement.

Having described the invention in detail and by reference to certain embodiments thereof, it will be apparent that modifications and variations are possible without departing from the scope of the invention which is defined in the appended claims.

What is claimed is:

1. A firefighter hood comprising:

a hood body configured to fit around a head of a wearer, wherein the hood body includes a face opening configured to be aligned with a face of the wearer when the hood is worn, and wherein said hood body is made of a flame resistant material and has a thermal protective performance rating of at least about twenty; and a flap coupled to the hood body, wherein the flap is movable between an extended position wherein said flap covers only part of said opening in front view, and a retracted position wherein said flap does not cover any of said opening in front view or covers less of said opening in front view compared to when said flap is in said extended position, wherein said flap is configured to be retained in said extended position in a cantilever arrangement, wherein at least part of the flap is positioned radially outwardly of said hood body, and wherein said flap has a height extending parallel to a height of said opening that is less than said height of said opening when said flap is in said extended position.

2. The hood of claim 1 wherein said face opening is generally oval.

3. The hood of claim 1 further comprising elastic material extending around an entire perimeter of said face opening.

4. The hood of claim 1 further comprising an airtight material extending around an entire perimeter of said face opening on an outermost surface of said hood body.

5. The hood of claim 1 wherein said flap is coupled to the hood body at or adjacent to the opening.

6. The hood of claim 1 wherein the hood body has a height dimension extending parallel to a height direction of a wearer when said hood is worn, wherein said height of said opening extends parallel to said height dimension of said hood body, and wherein said flap is coupled to said hood body at a connection location that is positioned away from the opening in said height direction no further than about ½ of the height of the opening.

7. The hood of claim 1 wherein the hood body has a height dimension extending parallel to a height direction of a wearer when said hood is worn, wherein said height of said opening extends parallel to said height dimension of said hood body.

8. The hood of claim 1 wherein said flap covers less than about 25% of a surface area of said opening in front view when said flap is in said extended position.

9. The hood of claim 1 wherein said flap has a surface area less than a surface area of said opening.

10. The hood of claim 1 wherein said flap is configured to be retained in said extended position due to at least one of a stiffness of said flap or a configuration of said flap.

11. The hood of claim 1 wherein said flap includes a base end attached to said body along a pivot line and a distal end positioned generally opposite said pivot line, and wherein said flap is configured to be retained in said extended position when said distal end is not directly attached to said body.

12. The hood of claim 1 wherein said flap is pivotally attached to the hood along a pivot line, and wherein said pivot line is non-linear.

13. The hood of claim 1 wherein said hood is configured to cover all of a wearer's head except for those portions of the wearer's head exposed through said face opening.

14. The hood of claim 1 wherein said hood body is made of an elastic material such that the hood body is stretchable at least about 10% in a particular direction from an unstretched position to a stretched position when stretching forces are applied and returns to its unstretched position when such stretching forces are removed.

15. The hood of claim 1 wherein said flap is configured to not cover any of said opening in front view when said flap is in said retracted position.

16. The hood of claim 1 wherein said flap is pivotally coupled to the hood body along a pivot line, and wherein the flap is pivotable about the pivot line when the flap moves between the extended position and the retracted position.

17. The hood of claim 16 wherein the flap is at least one of stitched or adhered to the hood body along the pivot line.

18. The hood of claim 16 wherein the pivot line is located on a radially outer surface of said hood body, and wherein the pivot line does not move relative to the face opening when the flap pivots about the pivot line between the extended position and the retracted position.

19. The hood of claim 1 wherein the flap is made of different piece of material than the hood body.

20. The hood of claim 1 wherein an entirety of the flap is positioned radially outwardly of the hood body when the flap is in the extended position.

21. The hood of claim 1 wherein the height of said flap is less than said height of said opening at a location of said flap when said flap is in said extended position.

22. A method for using a firefighter hood comprising:

accessing a hood including a hood body, a face opening and a flap coupled to the hood body, wherein said hood body is made of a flame resistant material and has a thermal protective performance rating of at least about twenty;

donning the hood such that the hood fits around a head of a wearer and the face opening is aligned with a face of the wearer; and moving the flap from one of an extended position and a retracted position to the other one of the extended position and the retracted position, wherein when the flap is in the extended position at least part of the flap is positioned radially outside the hood body and said flap is retained in said extended position in a cantilever arrangement, the flap has a height that is less than a height of the opening, and the flap covers only part of said opening in front view, and wherein when the flap is in the retracted position the flap does not cover any of said opening in front view or covers less of said opening in front view compared to when said flap is in said extended position.

23. A firefighter hood comprising:

a hood body configured to fit around a head of a wearer, wherein the hood body includes a face opening configured to be aligned with a face of the wearer when the hood is worn, the hood body further including an airtight material extending around a perimeter of said face opening; and a flap made of a different piece of material than the hood body and coupled to the hood body, wherein the flap is movable between an extended position wherein said flap covers only part of said opening in front view, and a retracted position wherein said flap does not cover any of said opening in front view or covers less of said opening in front view compared to when said flap is in said extended position, and wherein said flap is configured to be retained in said extended position in a cantilever arrangement.

24. The hood of claim 23 wherein the flap is pivotally coupled to the hood along a fixed pivot line that is located on a radially outer surface of the body.

* * * * *